United States Patent [19]

Spamer et al.

[11] Patent Number: 4,756,430

[45] Date of Patent: Jul. 12, 1988

[54] GRAVITY FEED SHELF

[75] Inventors: William S. Spamer, Roswell; David S. Leverette, Hartwell, both of Ga.

[73] Assignee: The Mead Corporation, Dayton, Ohio

[21] Appl. No.: 127,051

[22] Filed: Dec. 1, 1987

[51] Int. Cl.[4] ..... A47F 5/00

[52] U.S. Cl. ..... 211/59.2; 211/187; 211/193; 211/135; 108/108; 248/247

[58] Field of Search ..... 211/59.2, 193, 187, 211/135; 108/108, 111; 248/243, 247

[56] References Cited

U.S. PATENT DOCUMENTS

| | | | |
|---|---|---|---|
| 4,204,480 | 5/1980 | Hanna | 211/187 X |
| 4,294,363 | 10/1981 | Oztekin et al. | 211/59.2 |
| 4,314,648 | 2/1982 | Spamer | 211/135 X |
| 4,705,175 | 11/1987 | Howard et al. | 211/59.2 |
| 4,706,820 | 11/1987 | Spamer et al. | 211/59.2 |

*Primary Examiner*—Robert W. Gibson, Jr.
*Attorney, Agent, or Firm*—Rodgers & Rodgers

[57] ABSTRACT

A gravity feed shelf includes a plurality of chutes mounted on a rectangular frame having front and rear cross supports interconnected at their ends with a pair of side supports, the corner junctions between adjacent ends of the rear cross support and the side supports being formed by a lost motion connection in which front and back tabs on a support panel integral with each side support slide in slots formed in downwardly projecting elements of the rear cross support to accommodate sidewise motion of the side supports relative to the rear cross support so that variations in the horizontal spacing between vertical support posts on which the shelf is mounted due to manufacturing or installation procedures may be accommodated since the interconnection between these support posts and the shelf is via the rear ends of the side supports.

4 Claims, 1 Drawing Sheet

GRAVITY FEED SHELF

TECHNICAL FIELD

This invention relates to gravity feed shelves which are specially adapted for use in conjunction with store gondolas having horizontally spaced upright posts on which the shelf is mounted.

BACKGROUND ART

U.S. patent application Ser. No. 920,214 filed Oct. 17, 1986 and owned by the assignee of this invention discloses a special arrangement which adapts a particular gravity feed shelf for mounting on vertical support posts which may vary somewhat horizontally, such variation being accommodated by a lost motion connection at the rear corners of the shelf.

SUMMARY OF THE INVENTION

According to this invention in one form, a display shelf includes front and rear cross supports the ends of which are interconnected with the ends of a pair of spaced side supports to form a rectangular frame structure on which a plurality of low friction chutes are mounted and wherein the rear cross support is interconnected at its ends with the rear ends of the side supports by lost motion connections which include an inwardly projecting transverse support panel mounted on each of the side supports adjacent the rear ends thereof together with a front and back tab projecting from its front and back edges, such tabs being disposed within slots which are longer in their transverse dimensions than the transverse dimensions of the tabs and which slots are formed in elements which project downwardly from the rear cross support at the ends thereof.

BEST MODE OF CARRYING OUT THE INVENTION

Figure 1:
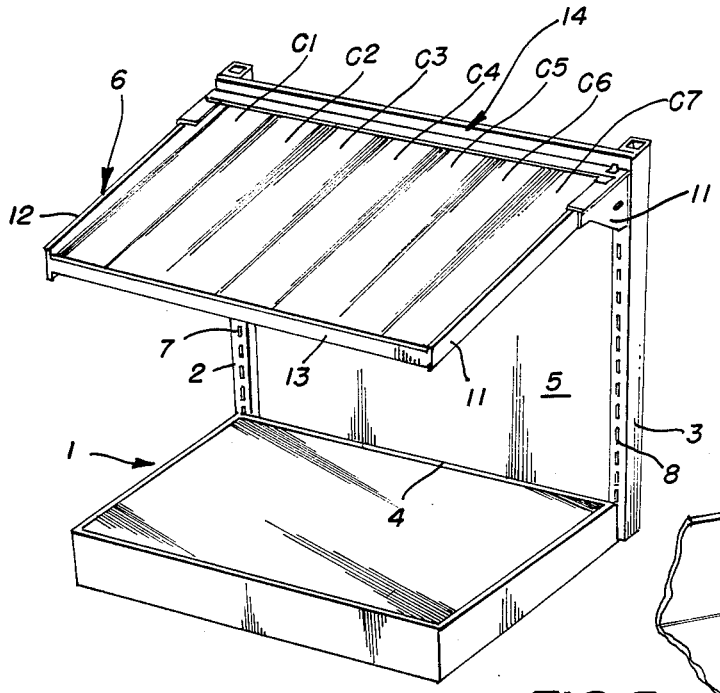
FIG. 1 is a perspective view of a gondola on which a shelf formed according to this invention is mounted.
Figure 5:
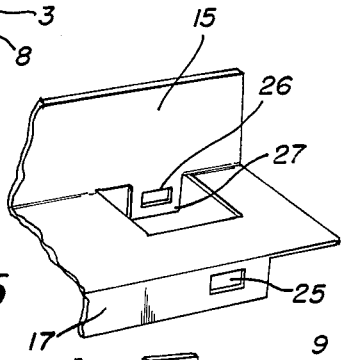
FIG. 5 is a fragmentary perspective view of one end of the back cross support.

In FIG. 1, the base of a gondola is generally designated by the numeral 1. Upright posts 2 and 3 are secured to the rear edge 4 of base 1 and a back 5 is secured to the posts 2 and 3. The shelf generally designated by the numeral 6 is constructed in accordance with this invention.

Posts 2 and 3 are provided with a plurality of vertically spaced apertures 7 and 8 respectively which are arranged to receive the positioning tabs such as 9 and the positioning hooks such as 10 which are formed along the rear edge of side supports 11 an 12. The front ends of side supports 11 and 12 are interconnected in known manner with a front cross support 13 and the rear ends of side supports 11 and 12 are interconnected with rear cross support 14 by lost motion connections formed according to this invention. This lost motion relationship between the rear ends of side supports 11 and 12 and the opposite ends of back cross support 14 is particularly applicable for use in conjunction with store gondolas since the spacing between uprights such as 2 and 3 may vary somewhat from unit to unit. Thus according to a main feature of this invention, the rear ends of side supports such as 11 and 12 may move horizontally relative to the rear cross support 14 thereby to accommodate variations in the horizontal spacing between vertical posts such as 2 and 3. A plurality of gravity feed chutes such as C1–C7 are mounted on the frame of shelf 6 and afford gravity feed of rows of product as is well known.

Figure 2:
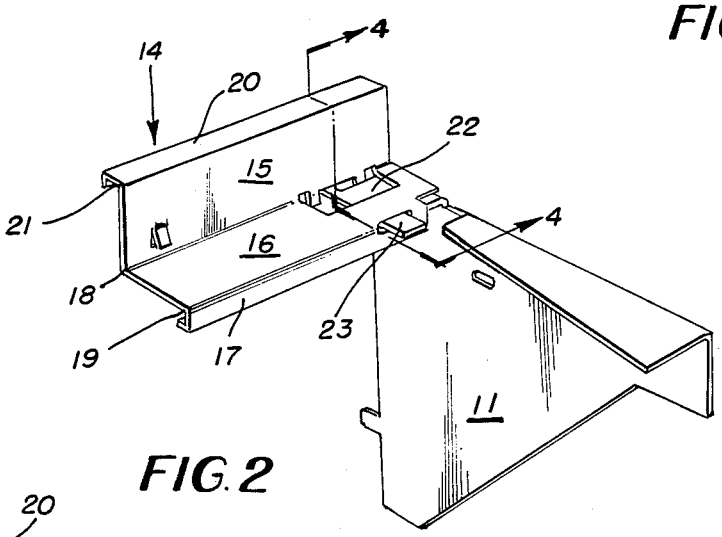
FIG. 2 is an enlarged perspective view of a corner junction between the rear end of one side support panel and one end of the rear cross support.
Figure 6:
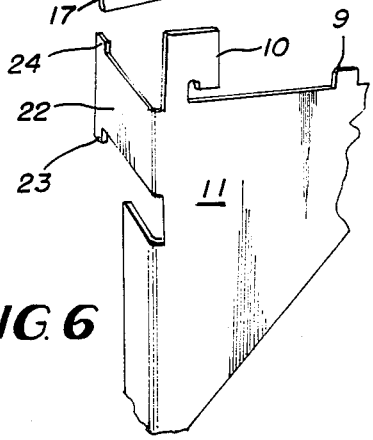
FIG. 6 is a fragmentary view of the back end of a side support.
Figure 4:
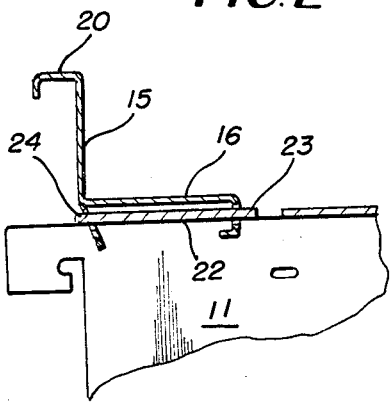
FIG. 4 is a cross sectional view taken along the line designated 4—4 in FIG. 2.
Figure 3:
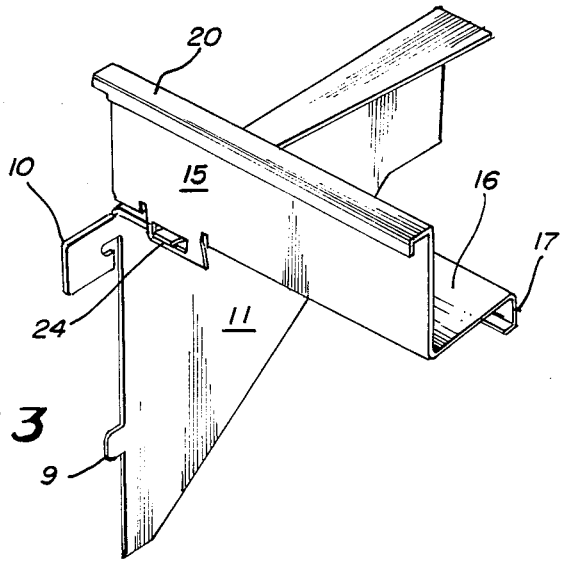
FIG. 3 is a view similar to FIG. 2 but taken from a different vantage point.

As is apparent from FIGS. 2, 3 and 4, the rear cross support 14 is a stepped structure including a first transverse strip 15 which extends between side supports 11 and 12 and is disposed in an imaginary vertical plane and a second transverse strip 16 which extends between side supports 11 and 12 and is disposed in an imaginary horizontal plane. A third transverse flange 17 extends between side supports 11 and 12 and is disposed in an imaginary vertical plane. Strip 16 is integrally formed at its rear edge 18 with the lower edge of strip 15 and at its forward edge 19 with the upper edge of vertically disposed horizontal flange 17. A horizontal upper strip 20 is integrally formed with the top edge 21 of strip 15. Strip 20 overlies the top edge of back wall 5.

For interconnecting the ends of cross support 14 with the side supports 11 and 12 by means of a lost motion connection, a transverse support panel 22 is mounted on each side support such as 11 and is arranged to project inwardly. Support panel 22 includes a front tab 23 and a back tab 24.

For cooperating with the front tab 23 a slot 25 in transverse flange 17 is formed, the slot 25 being greater in its transverse dimension than is the transverse dimension of the front tab 23. Back tab 24 is disposed within transverse slot 26 formed in downwardly projecting panel 27 formed integrally with transverse strip 15.

From the above description it is apparent that sidewise motion of side support 11 relative to rear cross support 14 may be accommodated thereby to adapt the shelf for mounting on posts such as 2 and 3 even though the horizontal spacing between such posts may vary somewhat. The bracket 9, 10, 11 being a single component affords advantages in manufacturing and installation over structures which utilize two parts.

We claim:

1. A display shelf for mounting on a pair of vertical spaced apart upright posts the spacing between which may vary somewhat, the shelf comprising a frame having front and back cross supports and a pair of side supports interconnected at their ends with the ends of said cross supports to form a rectangular frame and interconnected at their back ends respectively with said upright posts, a transverse inwardly projecting support panel formed on at least one of said side supports adjacent the back end thereof and having front and back tabs extending respectively from its front and back edges, said back cross support being of stepped configuration and including a first transverses strip disposed in a vertical plane, a second transverse strip integral with the lower edge of said first transverse strip and disposed in a horizontal plane, and a transverse flange integral with the front edge of said second transverse strip and extending between said side supports, a downwardly projecting panel formed on the lower edge of said first transverse strip, a transverse slot formed in said downwardly projecting panel for receiving said back tab and being of a length greater than the transverse dimension of said back tab, and a transverse slot formed in said flange for receiving said front tab and being of a length greater than the transverse dimension of said front transverse tab.

2. A display shelf according to claim 1 wherein said downwardly projecting panel is tilted forward so as positively to prevent said back tab from becoming dislodged from said transverse slot in said downwardly projecting panel.

3. A display shelf according to claim 1 wherein a reinforcing strip is integrally formed with said transverse flange along the lower edge of said transverse flange.

4. A display shelf according to claim 1 wherein the distance between the rear surface of said flange and the front surface of said first transverse strip is slightly less than the transverse dimension of said support panel plus the transverse dimension of one of said tabs.

* * * * *